US009697844B2

(12) United States Patent
Walsh et al.

(10) Patent No.: US 9,697,844 B2
(45) Date of Patent: Jul. 4, 2017

(54) DISTRIBUTED SPATIAL AUDIO DECODER

(75) Inventors: Martin Walsh, Scotts Valley, CA (US); Jean-Marc Jot, Aptos, CA (US); Edward Stein, Capitola, CA (US)

(73) Assignee: Creative Technology Ltd, Singapore (SG)

( * ) Notice: Subject to any disclaimer, the term of this patent is extended or adjusted under 35 U.S.C. 154(b) by 875 days.

(21) Appl. No.: 12/350,047

(22) Filed: Jan. 7, 2009

(65) Prior Publication Data

US 2009/0110204 A1 Apr. 30, 2009

Related U.S. Application Data

(63) Continuation-in-part of application No. 12/246,491, filed on Oct. 6, 2008, now Pat. No. 8,712,061, which is a continuation-in-part of application No. 11/750,300, filed on May 17, 2007, now Pat. No. 8,379,868, said application No. 12/246,491 is a continuation-in-part of application No. 12/047,285, filed on Mar. 12, 2008, now Pat. No. 8,345,899, said application No. 12/246,491 is a continuation-in-part of application No. 12/243,963, filed on Oct. 1, 2008, (Continued)

(51) Int. Cl.

| | |
|---|---|
| ***H04R 5/00*** | (2006.01) |
| ***G10L 19/16*** | (2013.01) |
| ***H04S 5/00*** | (2006.01) |
| *G10L 19/008* | (2013.01) |

(52) U.S. Cl.

CPC ..... *G10L 19/16* (2013.01); *H04S 5/005* (2013.01); *G10L 19/008* (2013.01); *H04R 2205/024* (2013.01); *H04R 2420/07* (2013.01)

(58) Field of Classification Search

CPC ..... H04S 1/002; H04S 7/302; H04S 5/005; G10L 19/16; G10L 19/008; H04R 5/02; H04R 2205/024; H04R 2420/07

USPC .. 381/77, 79, 310, 309, 300, 22, 23, 17, 18, 381/20, 21, 80; 455/3.06

See application file for complete search history.

(56) References Cited

U.S. PATENT DOCUMENTS 3,777,076 A * 12/1973 Takahashi ..... 369/89
5,890,125 A 3/1999 Davis et al.

(Continued)

FOREIGN PATENT DOCUMENTS

EP 1146775 A2 10/2001

*Primary Examiner* — Vivian Chin
*Assistant Examiner* — Con P Tran
(74) *Attorney, Agent, or Firm* — Russell Swerdon; Desmund Gean

(57) ABSTRACT

This invention describes a method for decentralized decoding of a multichannel audio signal by broadcasting the original encoded data and distributing the decoding process between a plurality of receiving units. This allows for the design and manufacture of scalable multichannel audio reproduction systems having an arbitrary number of output channels, composed of a plurality of generic decoder and loudspeaker units each generating fewer output channels. With distributed decoding, a manufacturer can use "off-the-shelf" stereo or mono signal processors, digital-to-analog converters and amplifier components in each generic decoding module, thus reducing manufacturing costs and complexity requirements for each module while offering unlimited scalability in the total number of output channels.

20 Claims, 5 Drawing Sheets

Related U.S. Application Data now Pat. No. 8,374,365, which is a continuation-in-part of application No. 11/835,403, filed on Aug. 7, 2007, now Pat. No. 8,619,998, said application No. 12/243,963 is a continuation-in-part of application No. 11/750,300, filed on May 17, 2007, now Pat. No. 8,379,868.

(60) Provisional application No. 60/977,432, filed on Oct. 4, 2007, provisional application No. 61/102,002, filed on Oct. 1, 2008, provisional application No. 60/747,532, filed on May 17, 2006, provisional application No. 60/894,437, filed on Mar. 12, 2007, provisional application No. 60/977,432, filed on Oct. 4, 2007, provisional application No. 60/977,345, filed on Oct. 3, 2007, provisional application No. 60/821,702, filed on Aug. 7, 2006.

(56) References Cited

U.S. PATENT DOCUMENTS

| | | | | |
|---|---|---|---|---|
| 6,487,296 | B1 * | 11/2002 | Allen et al. | 381/80 |
| 6,684,060 | B1 * | 1/2004 | Curtin | 375/146 |
| 6,826,283 | B1 * | 11/2004 | Wheeler | H04H 20/63 379/101.01 |
| 7,853,022 | B2 | 12/2010 | Thompson et al. | |
| 7,970,144 | B1 | 6/2011 | Avendano et al. | |
| 2004/0223622 | A1 * | 11/2004 | Lindemann et al. | 381/79 |
| 2004/0234088 | A1 * | 11/2004 | McCarty et al. | 381/306 |
| 2005/0053249 | A1 * | 3/2005 | Wu et al. | 381/310 |
| 2005/0190928 | A1 * | 9/2005 | Noto | 381/77 |
| 2006/0153155 | A1 | 7/2006 | Jacobsen et al. | |
| 2006/0159280 | A1 * | 7/2006 | Iwamura | 381/79 |
| 2007/0087686 | A1 * | 4/2007 | Holm et al. | 455/3.06 |
| 2007/0211907 | A1 * | 9/2007 | Eo et al. | 381/79 |
| 2008/0002842 | A1 | 1/2008 | Neusinger et al. | |
| 2008/0097750 | A1 * | 4/2008 | Seefeldt et al. | 704/201 |
| 2009/0067640 | A1 * | 3/2009 | McCarty et al. | 381/77 |
| 2009/0081948 | A1 * | 3/2009 | Banks et al. | 455/3.05 |
| 2009/0129601 | A1 | 5/2009 | Ojala et al. | |
| 2009/0150161 | A1 | 6/2009 | Faller | |

* cited by examiner

DISTRIBUTED SPATIAL AUDIO DECODER

CROSS-REFERENCE TO RELATED APPLICATIONS

This application is a continuation-in-part of U.S. patent application Ser. No. 12/246,491, filed 6 Oct. 2008, and entitled "Phase-Amplitude 3-D Stereo Encoder and Decoder", which claims the benefit of U.S. Provisional Patent Application Ser. No. 60/977,432, filed on 4 Oct. 2007, and entitled "Phase-Amplitude Stereo Decoder and Encoder", and of U.S. Provisional Patent Application Ser. No. 61/102,002, filed on 1 Oct. 2008, and entitled "Phase-Amplitude Stereo Decoder and Encoder", and which is a continuation-in-part of U.S. patent application Ser. No. 11/750,300, filed 17 May 2007, and entitled "Spatial Audio Coding Based on Universal Spatial Cues", which claims the benefit of U.S. Provisional Patent Application Ser. No. 60/747,532, filed on 17 May 2006, and entitled "Spatial Audio Coding Based on Universal Spatial Cues", and which is a continuation-in-part of U.S. patent application Ser. No. 12/047,285, filed 12 Mar. 2008, and entitled "Phase-Amplitude Matrixed Surround Decoder", which claims the benefit of U.S. Provisional Patent Application Ser. No. 60/894,437, filed on 12 Mar. 2007, and entitled "Phase-Amplitude Stereo Decoder and Encoder", and of U.S. Provisional Patent Application Ser. No. 60/977,432, filed on 4 Oct. 2007, and entitled "Phase-Amplitude Stereo Decoder and Encoder", and which is a continuation-in-part of U.S. patent application Ser. No. 12/243,963, filed 1 Oct. 2008, and entitled "Spatial Audio Analysis and Synthesis for Binaural Reproduction and Format Conversion", which claims the benefit of U.S. Provisional Patent Application Ser. No. 60/977,345, filed on 3 Oct. 2007, entitled "Spatial Audio Analysis and Synthesis for Binaural Reproduction", and of U.S. Provisional Patent Application Ser. No. 61/102,002, filed on 1 Oct. 2008, and entitled "Phase-Amplitude Stereo Decoder and Encoder", all of the disclosures of which are incorporated by reference for all purposes herein.

Further, this application is a continuation-in-part of U.S. patent application Ser. No. 11/835,403, filed 7 Aug. 2007, and entitled "Spatial Audio Enhancement Processing Method and Apparatus", which claims the benefit of U.S. Provisional Patent Application Ser. No. 60/821,702, filed on 7 Aug. 2006, entitled "Stereo Spreader and Crosstalk Canceller with Independent Control of Spatial and Spectral Attributes", all of the disclosures of which are incorporated by reference for all purposes herein.

U.S. patent application Ser. No. 12/047,285 and U.S. patent application Ser. No. 12/243,963 are continuation-in-parts of U.S. patent application Ser. No. 11/750,300, filed 17 May 2007, and entitled "Spatial Audio Coding Based on Universal Spatial Cues", which claims the benefit of U.S. Provisional Patent Application Ser. No. 60/747,532, filed on 17 May 2006, and entitled "Spatial Audio Coding Based on Universal Spatial Cues", the disclosures of which are incorporated by reference for all purposes herein.

BACKGROUND OF THE INVENTION

1. Field of the Invention

The present invention relates to surround sound decoding and distribution techniques.

2. Description of the Related Art

Multichannel audio reproduction typically uses a plurality of loudspeakers distributed around a listener, or group of listeners, to convey a sense of immersion or envelopment from a reproduced audio recording or soundtrack or an artificially rendered acoustic event. Multichannel audio was first popularized in movie soundtracks. Movie theaters use a network of loudspeakers distributed throughout the performance space to surround the audience. Multichannel audio has also become popular in homes with the advent of multichannel movie and music soundtrack recordings available on DVD and Blu-ray discs and interactive multichannel soundtracks from gaming consoles and personal computers.

Multichannel audio is often compressed such that the amount of data required to accommodate a high quality soundtrack reproduction is sufficiently reduced to fit on a given physical storage medium or to allow for streaming of that data within a given bitstream bandwidth. Such compression schemes include Dolby Digital or DTS for DVD, Blu-ray disc and HDTV. These encoded data streams are usually passed to an external decoder on a home theater receiver and the decoded PCM soundtrack is directed by wire to multiple output channels for distribution around the listening room. Multichannel audio can also be produced and mixed on the fly by console or PC gaming engines. Multichannel audio can also be created through a special decode of matrix-encoded stereo soundtracks using algorithms such as Dolby Pro Logic or algorithms based on the theory outlined in U.S. patent application Ser. No. 12/246,491. A multichannel soundtrack can also be produced by 'upmixing' a traditional stereo soundtrack to a multichannel mix using algorithms such as Creative CMSS-3D Surround, DTS Neo 6 and SRS Circle Surround.

The multichannel audio signals 102 (transmitted, e.g., over a SPDIF connection) are typically decoded and amplified in a single piece of equipment, typically a home theater receiver 104 or a set-top box that distributes each individual reproduction channel by wired loudspeaker connection 106, as shown in FIG. 1. The majority of newer multichannel amplifiers available today will support up to a maximum of 7.1 channel output (i.e., 7 main loudspeaker channels and one subwoofer channel). Newer wireless technologies allow for the wireless transmission of audio channels using, for instance, the Bluetooth Advanced Audio Distribution Profile (A2DP). This approach alleviates the need for unsightly wiring connecting the main amplifier to the rear loudspeakers.

Often, the data rate of home wireless audio transmissions is limited and only allows for the transmission of two channels of audio data, for instance. Hence, in many wireless multichannel audio playback solutions, only a subset of the audio channels can be transmitted wirelessly, while the other channels require wired loudspeaker connections.

In any wireless multichannel audio reproduction system where audio channel signals are transmitted discretely, increasing the number of wireless loudspeakers requires a proportional increase in wireless transmission bandwidth. This ultimately limits flexibility and scalability in wireless multichannel audio systems. Furthermore, increasing the number of channels may require replacing common components such as signal processors, digital-to-analog converters, or amplifiers by special (non generic) components, and require the shared multichannel decoder or amplifier unit to have larger cost, power consumption and size. Therefore, improved techniques and systems for multichannel audio decoding and distribution are needed.

SUMMARY OF THE INVENTION

This invention describes a method for decentralized decoding of a multichannel audio signal by broadcasting the original encoded data and distributing the decoding process between a plurality of receiving units. This allows for the design and manufacture of scalable multichannel audio reproduction systems having an arbitrary number of output channels, composed of a plurality of generic decoder and loudspeaker units each generating fewer output channels. With distributed decoding, a manufacturer can use "off-the-shelf" stereo or mono signal processors, digital-to-analog converters and amplifier components in each generic decoding module, thus reducing manufacturing costs and complexity requirements for each module while offering unlimited scalability in the total number of output channels.

According to one aspect of the invention, a method is provided for reproducing multichannel audio. The method includes transmitting a multichannel audio encoded source signal to multiple decoder processing units each having an output channel with a position in a listening environment. An output signal from the output channel is determined by the output channel position while the source signal is independent of the output channel positions in the listening environment.

According to another aspect of the invention, a system is provided for multichannel audio reproduction. The system includes a distributed network of multichannel audio decoders where each decoder is operable to receive an identical encoded audio data stream and reproduce only the audio signals from the encoded audio data stream that are relevant for an associated loudspeaker signal output identified by the position of the associated loudspeaker relative to a reference position.

Yet, according to another aspect of the present invention, a method is provided for reproducing a multichannel audio signal. The method includes broadcasting via a wireless stereo audio transmitter a two-channel phase-amplitude encoded audio signal; receiving via a plurality of stereo wireless receivers the encoded audio signal; and processing via a phase-amplitude stereo decoder the received audio signal, wherein the processing decodes only the audio signals relevant for a predetermined position.

These and other features and advantages of the present invention are described below with reference the drawings.

DETAILED DESCRIPTION OF PREFERRED EMBODIMENTS

Figure 1:
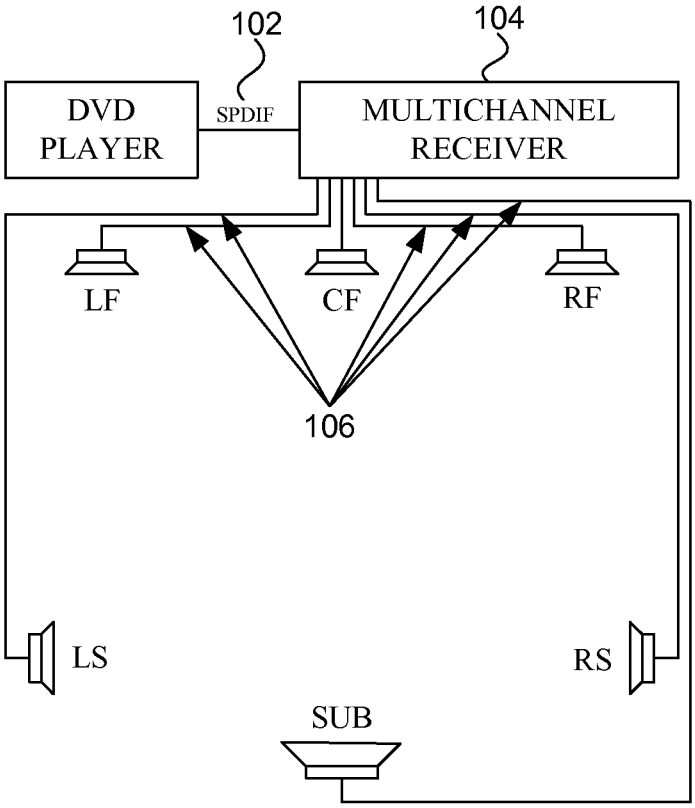
FIG 1 (Prior Art)
FIG. 1 is a simplified functional diagram illustrating a wired 5.1 channel surround sound reproduction system with a DVD player connected to a multichannel receiver using a single SPDIF connection.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

In general, the present invention provides a multichannel speaker system where each speaker is aware of its position relative to some reference and decodes the audio signals most relevant for that position. Each speaker receives the same encoded data stream but only decodes/outputs the portions of that stream associated to its position. Specifically, each decoder is configurable to produce particular output channels without deriving any of the other ones. The encoded audio stream could be analogue, digital, compressed, stereo, multichannel, etc.

In accordance with one embodiment of the present invention, provided are a method and system comprising a plurality of multichannel audio decoders where each decoder receives the same encoded audio data stream and reproduces only the audio signals relevant for an associated loudspeaker signal output (or a subset of loudspeaker outputs) identified by the position of the associated loudspeaker(s) relative to some reference position.

In accordance with another embodiment of the present invention, provided are a method and system for multichannel audio reproduction comprising a wireless stereo audio transmitter broadcasting a two-channel phase-amplitude encoded audio signal generated, for instance, with an embodiment of the encoder described in U.S. patent application Ser. No. 12/246,491. This broadcast is received by a plurality of separate stereo wireless receivers. The received stereo audio is further processed by a phase-amplitude stereo decoder, such as an embodiment of the decoder described in U.S. patent application Ser. No. 12/246,491, which decodes only the audio signals most relevant for a predetermined position, or a predetermined subset of positions, usually determined by the position of at least one loudspeaker relative to a reference position.

In accordance with another embodiment of the present invention, the plurality of wireless stereo loudspeaker units each contain a stereo wireless receiver, a decoder (e.g., a phase-amplitude decoder such as an embodiment of the decoder described in U.S. patent application Ser. No. 12/246,491), and a network of transaural loudspeaker virtualization filters that provide the perception of more loudspeakers than are physically present in vicinity around the physical location of the reproducing stereo loudspeaker.

Figure 2A:
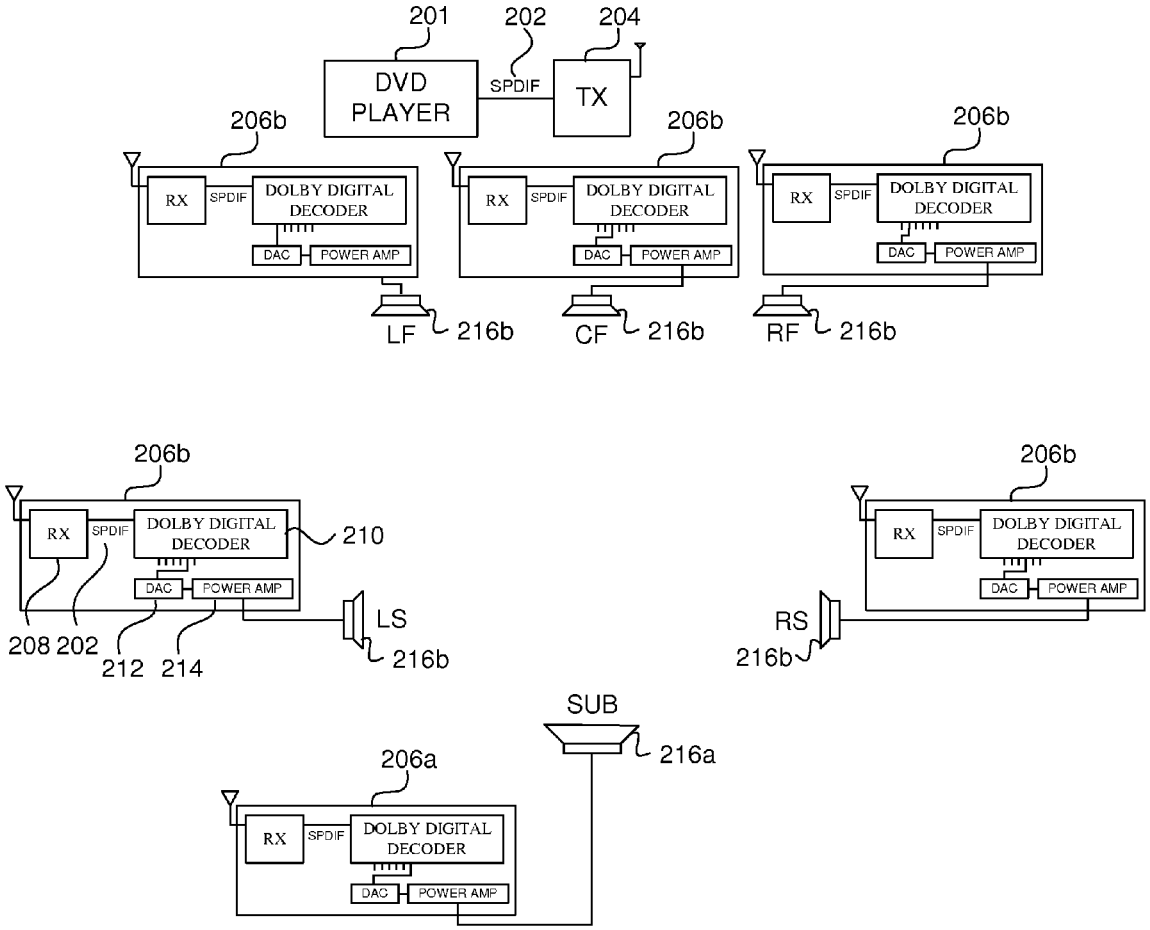
FIG. 2A is a functional diagram illustrating a wireless 5.1 channel surround sound reproduction system with a DVD player connected to a wireless SPDIF signal transmitter and a plurality of wireless SPDIF signal receivers, each of which direct the received SPDIF signal to a Dolby Digital decoder and directs the decoded channel that is associated with the connected loudspeaker driver through a mono DAC and power amplifier.

To begin, FIG. 2A illustrates a 5.1 channel 'home theater' set up, whereby a DVD player 201 outputs a Dolby Digital stream in SPDIF format 202. In this specific embodiment, the SPDIF data stream 202 is 'broadcast' using a wireless data transmitter 204. The data stream is received by a subwoofer unit 206*a* and five loudspeaker units 206*b* that each includes a wireless SPDIF receiver 208 which, in turn, feeds an audio signal processor executing a Dolby Digital decoder 210. The output of the decoder 210 is adapted such that only the audio channel pertinent to the loudspeaker 216 (i.e., 216*a*, 216*b*) position is output to the associated digital-to-analog converter (DAC) 212 and power amplifier 214. Any technique may be used to make the loudspeaker position known to the decoder 210. For example, a manual or automatic speaker location detection technique can be implemented by the decoder 210. The receiving loudspeaker unit 206 (i.e., 206*a*, 206*b*) may be battery powered or it may be powered by a wall power socket.

Figure 2B:
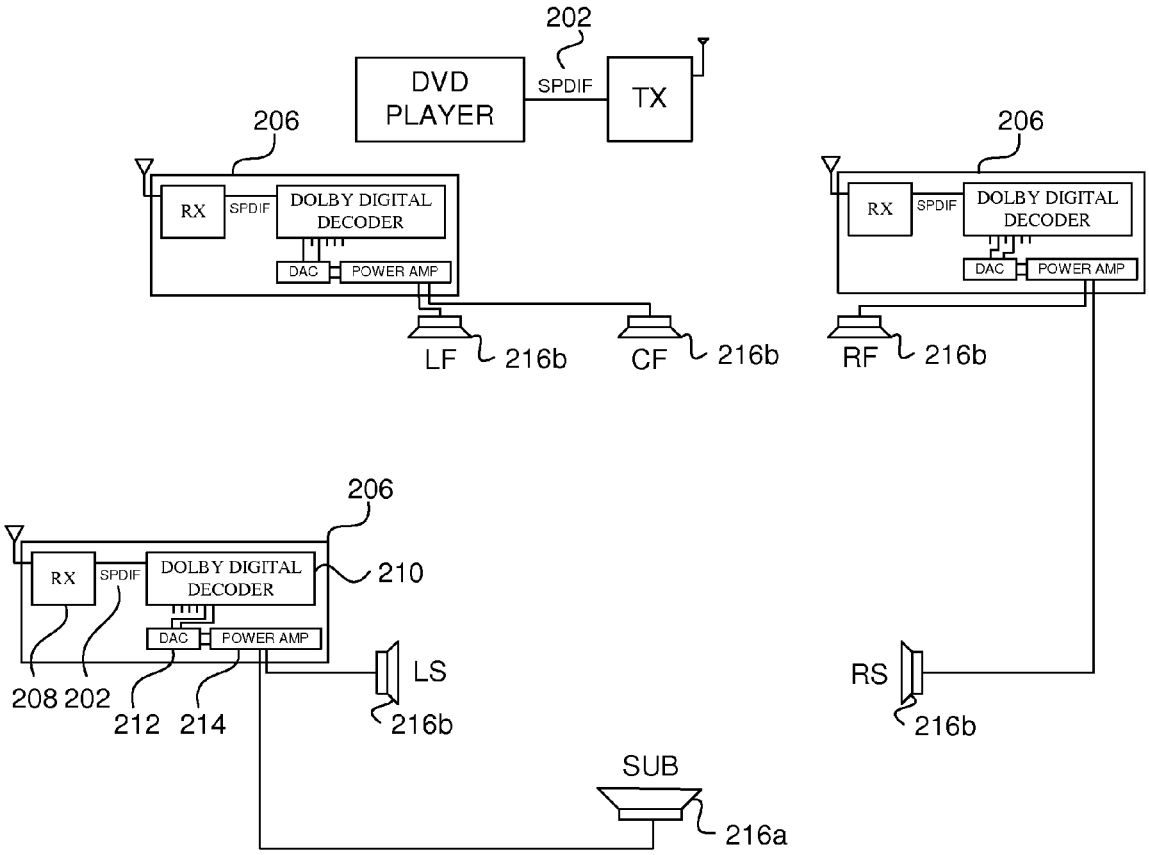
FIG. 2B is a functional diagram illustrating a wireless 5.1 channel surround sound reproduction system with a DVD player connected to a wireless SPDIF signal transmitter and a plurality of wireless SPDIF signal receivers, each of which direct the received SPDIF signal to a Dolby Digital decoder and directs a pair of decoded channels that are associated with a pair of connected loudspeaker drivers through a stereo DAC and power amplifier.

In some embodiments, two or more channels are reproduced in some DSP and amplification units. This allows a potentially more economical use of common/commodity stereo audio parts to be used in the system, such as stereo DACs and amplifiers. Such an embodiment is illustrated in FIG. 2B. One can extend this to include a subwoofer 216*a* which may be attached to one or more of the receiver loudspeaker units 206.

In some embodiments, the encoded audio stream transmission is wired and distributed centrally or in a daisy chain from decoder to decoder by means of a SPDIF signal repeater.

In some embodiments, each loudspeaker unit includes post-processing to recalibrate the decoded output signal in order to compensate for improper loudspeaker setup.

The multichannel audio encoding format may be any analog or digital format, e.g. DTS, Dolby Digital, MP3 Surround, MPEG Surround, Microsoft WAV Extensible, WMA etc.

In some embodiments, the soundtrack is broadcast to a plurality of receivers and decoders as part of a public performance installation, such as a movie theater. Possible digital protocols used for broadcast and receipt of the wireless signals might include SPDIF, HDMI, Bluetooth AD2P, Satellite or HD radio, 802.11x, 2.4 GHz etc.

In another preferred embodiment, the source material represents the streamed or stored output of a phase-amplitude 3-D stereo matrix encoder described in U.S. patent application Ser. No. 12/246,491. The encoded material may have originated from a discrete multichannel movie, game or music soundtrack or the encoder may have been a part of a real-time multichannel mixing engine in applications such as interactive gaming. The resulting stereo signal is transmitted wirelessly to a network of receivers, each having an associated subset of decoders, amplifiers and loudspeakers. The stereo signal can be transmitted and received using analog or digital transmission methods. Digital representations can also be compressed before transmission using algorithms such as AAC, MP3 or WMA. The output of each wireless receiver is followed by a DSP which implements a frequency-domain phase-amplitude stereo decoder such as an embodiment of the methods described in U.S. patent application Ser. No. 12/246,491. As described in U.S. patent application Ser. No. 12/246,491, such a decoder is capable of rendering an arbitrary number of output channels, adapting each decoded output for the position of the associated loudspeakers. This property of the decoder results in a scalable, self-configuring, multichannel loudspeaker playback system employing a distributed decoding method according to the present invention.

Figure 3:
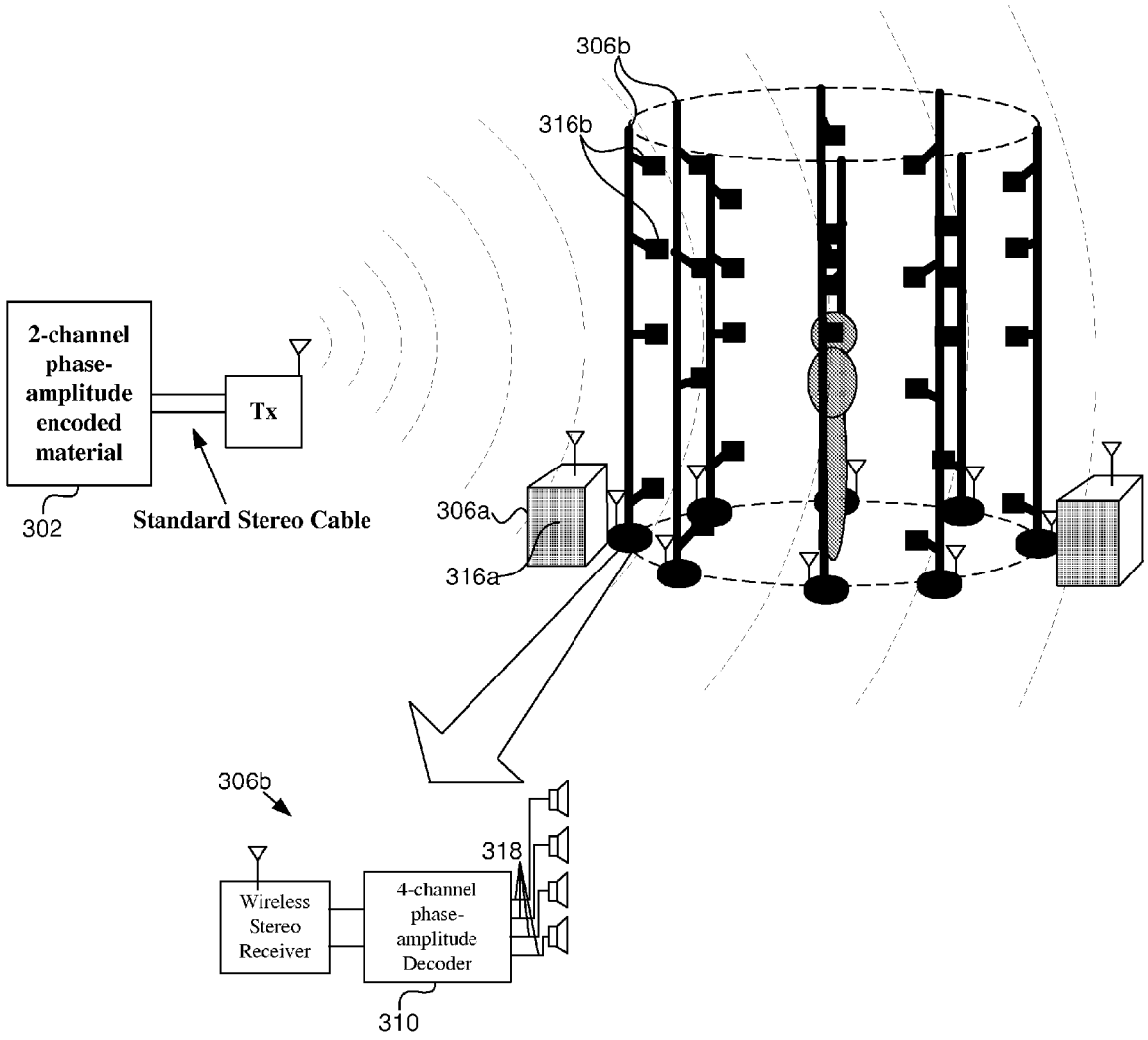
FIG. 3 is a diagram illustrating a multichannel decoder system that implements a distributed decode of a wirelessly transmitted phase-amplitude encoded stereo signal by means of two wireless subwoofers and a group of eight vertical loudspeaker bars that each process the same encoded stereo signal but decode only to four channels that are associated with the positions of the four loudspeaker drivers distributed along each vertical loudspeaker bar.

As shown in FIG. 3, the wireless stereo broadcast signal of phase-amplitude encoded material 302 is received by multiple loudspeaker units 306 (i.e., a network of eight wireless, vertically standing, loudspeaker bars 306*b* and two wireless subwoofers 306*a*). Each loudspeaker bar 306*b* contains four independent loudspeaker drivers 316*b* which can be positioned anywhere along the length of the bar. Upon receiving the stereo wireless signal, a signal processor that is embedded at the base of each vertical loudspeaker bar implements a frequency-domain phase-amplitude stereo decoder 310, such as an embodiment of the methods described in U.S. patent application Ser. No. 12/246,491. Each decoder 310 generates a set of four output signals 318, adapted for each loudspeaker 316 (i.e., 316*a*, 316*b*) location relative to the listener. The DSP system therefore needs to know these individual loudspeaker positions in advance of decoding the stereo wireless signal. This can be done by some method of manual or automatic calibration measurement using a centrally placed microphone. Alternative methods of detecting the position of each loudspeaker location can be used in other embodiments. If the loudspeaker positions are modified or if fewer or more vertical loudspeaker bars are introduced, the user can recalibrate the system to account for the changes. In this embodiment, two subwoofers 306*a* also receive the wireless stereo stream, decoding the relevant low-frequency signals only.

In some embodiments, there is a smaller or larger number of loudspeaker elements 316*b* on each loudspeaker bar 306*b*, possibly a single element. In some embodiments, the system comprises a smaller or larger number of subwoofers 306*a*, 316*a*.

In some embodiments, the reproduction system is self configuring in that it can sense the initial setup, addition, removal or malfunction of decoder/loudspeaker units and specify or re-specify the parameters of each of the units in the system as a result. That is, the system can self configure based on the position and number of speakers present. Any technique may be used by the DSP system to detect speaker location. For example, speaker location detection techniques may include use of an acoustic calibration test, machine vision technologies, IR, cameras, wireless receiver triangulation, or simple channel labeling (FL, C, FR, SR, SL, etc.).

Figure 4:
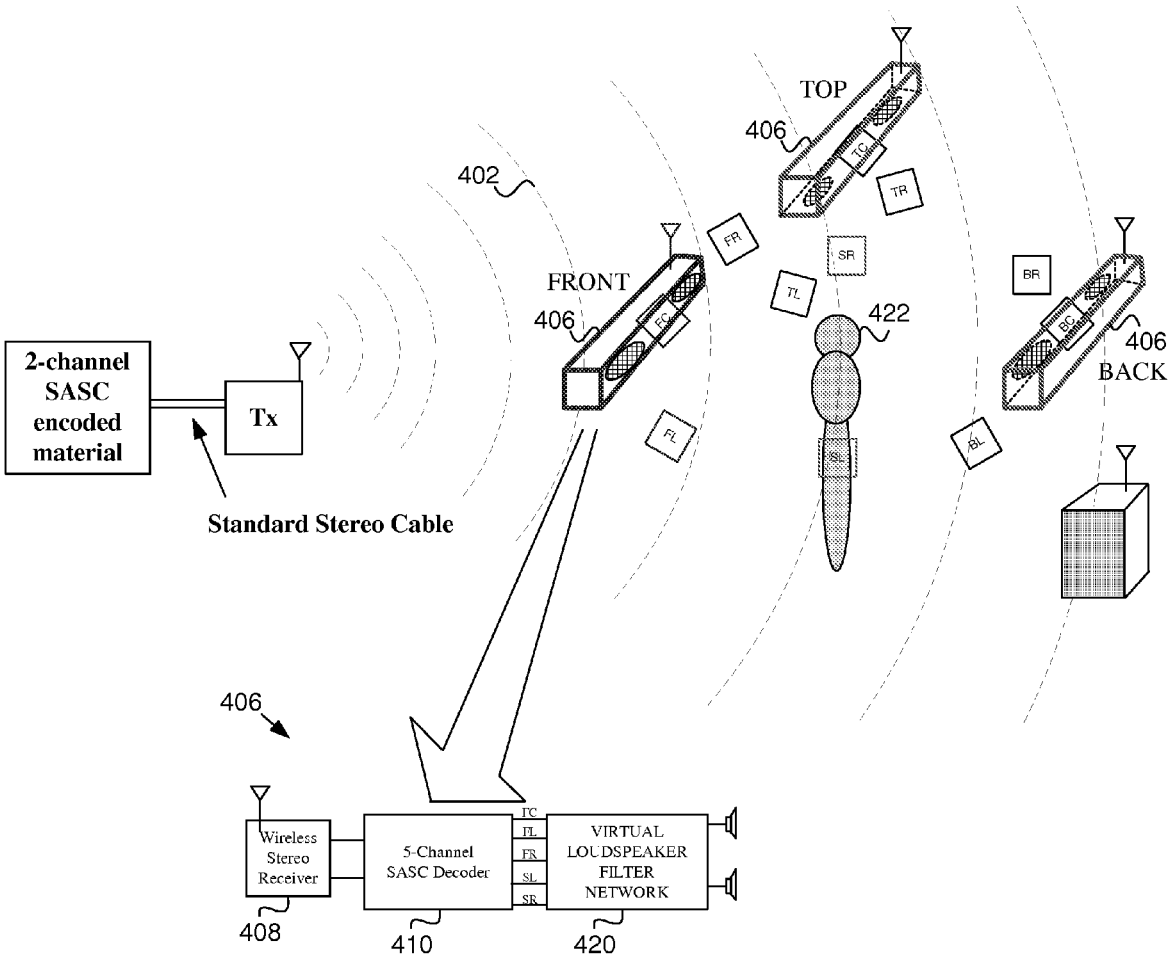
FIG. 4 is a diagram illustrating a multichannel decoder system that implements a distributed decode of a wirelessly transmitted phase-amplitude encoded stereo signal by means of a subwoofer with built-in wireless receiver and three stereo loudspeaker units that each contain a wireless receiver and a signal processor implementing a multichannel phase-amplitude decoder and a network of loudspeaker virtualization filters each of which decode and virtualize loudspeaker positions associated with the placement of the individual stereo speakers.

In another embodiment (illustrated in FIG. 4), in which the source material is the output of a phase-amplitude 3-D stereo matrix encoder such as described in U.S. patent application Ser. No. 12/246,491, the broadcast stereo signal 402 is received by one or more stereo loudspeaker units 406 that each contain a stereo wireless receiver 408, an embedded signal processor that implements a frequency-domain phase-amplitude decoder 410, such as described in U.S. patent application Ser. No. 12/246,491, and a network of transaural loudspeaker virtualization filters 420 that collectively provide the perception of more loudspeakers than are physically present in vicinity around the physical location of the reproducing stereo loudspeaker. The network of transaural filters can be designed and implemented using the methods described in U.S. patent application Ser. No. 11/835,403. Such a system is illustrated in FIG. 4. In this example, the phase-amplitude decoder 410 associated with the front loudspeaker unit 406 decodes a front-left, front-right, front center, side-left and side-right channel and the associated processor performs additional processing that virtualizes each decoded channel signal to the desired positions for a single listener sitting at the "sweet spot" 422 using the two physical front loudspeaker transducers. The frequency-domain phase-amplitude decoder 410 associated with the top loudspeaker unit 406 decodes a top-left, top-right, and top-center channel and the associated processor performs additional processing that virtualizes each decoded channel to the desired position for a single listener sitting at the sweetspot using the two physical loudspeaker transducers above the listener's head. The frequency-domain phase-amplitude decoder 410 associated with the back loudspeaker unit 406 decodes a back-left, back-right, back-center, side-left and side-left channel, and the associated processor performs additional processing that virtualizes each decoded channel to the desired positions for a single listener sitting at the "sweet spot" 422 using the two physical loudspeaker transducers behind the listeners head. The result of this full network of virtual loudspeakers yields a sense of being surrounded by an array of individual loudspeakers that is larger than is physically present. Since both the front and back loudspeaker units virtualize the side-left and side-right loudspeaker locations, the gains of the side channel outputs of the front and back decoders can be power-normalized in each corresponding decoder.

In some embodiments, the top loudspeaker unit is not present and the phase-amplitude decoders 410 associated with the front and back loudspeaker units 406 both render the top-left, top-right, and top-center channel signals. The virtual loudspeaker virtualization block for the front and back loudspeaker units now also implement virtual top-left, top-right, and top-center speakers. Since, both the front and back loudspeaker units virtualize the top loudspeaker locations, the gains of the top channels outputs of the decoders can be power-normalized. In some embodiments, a greater or lower number of loudspeaker units 406 are present, each rendering a greater or lower number of virtual loudspeaker positions.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for reproducing multichannel audio, comprising:

transmitting a multichannel audio encoded source signal to a plurality of decoder processing units in a decentralized decoder system for decentralized decoding of the multichannel audio source signal, each decoder processing unit in the plurality of decoder processing units including an output channel associated with a different physical location in a listening environment, each decoder processing unit being aware of its relative physical location in the listening environment, wherein the decentralized decoder system is configured such that if an initial setup for the plurality of decoder processing units is modified, the decentralized decoder system can reconfigure parameters based on either detecting new positions and number of decoder processing units or detecting new positions and number of output channels in the modified setup, wherein an output signal from each output channel is determined by the output channel position while the source signal is independent of the output channel positions in the listening environment, and wherein the output channel position is determined automatically.

2. The method of claim 1, further comprising:

receiving the multichannel audio encoded source signal by the plurality of decoder processing units; and decoding the multichannel audio encoded source signal in determining and generating the output signal.

3. The method of claim 2, further comprising:

converting the output signal into a different signal type.

4. The method of claim 3, further comprising:

amplifying the converted output signal.

5. The method of claim 2, further comprising:

virtualizing the output signal.

6. The method of claim 1, wherein each output channel position corresponds to a loudspeaker position in the listening environment.

7. The method of claim 1, wherein the multichannel audio encoded source signal is 2-channel encoded material.

8. The method of claim 7, wherein the 2-channel encoded material is 2-channel phase-amplitude encoded material.

9. The method of claim 1, wherein the at least two output channels have corresponding positions on a common vertical axis in the listening environment.

10. The method of claim 1, wherein the at least two output channels have corresponding positions on different vertical axes in the listening environment.

11. A system for multichannel audio reproduction, comprising:

a distributed network of multichannel audio decoders in a decentralized decoder system for decentralized decoding of an encoded audio data stream, where each decoder is operable to receive an identical version of the encoded audio data stream and reproduce only the audio signals from the encoded audio data stream that are relevant for an associated loudspeaker with an identified physical location relative to a reference position in a listening environment, wherein the identified physical locations are detected and determined automatically and each loudspeaker is aware of its relative physical location in the listening environment, wherein the decentralized decoder system is configured such that if an initial setup for the distributed network of multichannel audio decoders is modified, the decentralized decoder system can reconfigure parameters based on either detecting new positions and number of multichannel audio decoders or detecting new positions and number of loudspeakers in the modified setup.

12. The system of claim 11, further comprising:

a network of transaural filters for virtualizing the reproduced audio signals, the network of transaural filters being coupled to the distributed network of multichannel audio decoders.

13. The system of claim 11, wherein the distributed network of multichannel audio decoders are implemented in a wireless setup.

14. The system of claim 11, wherein the distributed network of multichannel audio decoders are implemented in a wired setup.

15. The system of claim 11, wherein the identified positions are determined prior to reproducing the audio signals.

16. The system of claim 11, wherein the multichannel audio decoders are frequency-domain phase-amplitude decoders.

17. The system of claim 11, wherein the encoded audio data stream is a 2-channel encoded material.

18. A method for reproducing a multichannel audio signal, comprising:

broadcasting via a wireless stereo audio transmitter a two-channel phase-amplitude encoded audio signal;

receiving, via a plurality of stereo wireless receivers in a decentralized decoder system for decentralized decoding of the encoded audio signal, the encoded audio signal; and processing via a phase-amplitude stereo decoder the received audio signal, wherein the processing decodes only the audio signals relevant for at least two associated loudspeakers with different corresponding channels and identified physical locations in a listening environment, wherein the identified physical locations are detected and determined automatically and each loudspeaker is aware of its relative physical location in the listening environment, wherein the decentralized decoder system is configured such that if an initial setup for the plurality of stereo wireless receivers is modified, the decentralized decoder system can reconfigure parameters based on either detecting new positions and number of stereo wireless receivers or detecting new positions and number of loudspeakers in the modified setup.

19. The method of claim 18, wherein the decoded audio signals are determined by the position of at least one loudspeaker relative to a reference position.

20. The method of claim 19, wherein each decoder is coupled to a network of transaural loudspeaker virtualization processors.

* * * * *